US006179961B1

(12) United States Patent
Ficke et al.

(10) Patent No.: US 6,179,961 B1
(45) **Date of Patent: *Jan. 30, 2001**

(54) TISSUE PAPER HAVING A SUBSTANTIVE ANHYDROUS SOFTENING MIXTURE DEPOSITED THEREON

(75) Inventors: Jonathan Andrew Ficke, Lawrenceburg, IN (US); Kenneth Douglas Vinson, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/947,422

(22) Filed: Oct. 8, 1997

(51) Int. Cl.[7] ..... D21H 21/22

(52) U.S. Cl. ..... 162/127; 162/112; 162/113; 162/109; 162/134; 162/135; 162/158; 162/164.4; 162/179

(58) Field of Search ..... 162/112, 111, 162/113, 109, 135, 136, 158, 179, 134, 127, 164.4

(56) References Cited

U.S. PATENT DOCUMENTS

| | | | | |
|---|---|---|---|---|
| H1672 | | 8/1997 | Hermans et al. | 162/148 |
| 3,305,392 | | 2/1967 | Britt . | |
| 4,300,981 | | 11/1981 | Carstens | 162/109 |
| 4,351,699 | * | 9/1982 | Osborn, III | 162/179 |
| 4,874,465 | | 10/1989 | Cochrane et al. | 162/111 |
| 5,059,282 | | 10/1991 | Ampulski et al. | 162/111 |
| 5,215,626 | | 6/1993 | Ampulski et al. | 162/112 |
| 5,228,954 | | 7/1993 | Vinson et al. | 162/100 |
| 5,246,545 | | 9/1993 | Ampulski et al. | 162/112 |
| 5,264,082 | | 11/1993 | Phan et al. | 162/158 |
| 5,405,499 | | 4/1995 | Vinson | 162/100 |
| 5,487,813 | | 1/1996 | Vinson et al. | 162/111 |
| 5,525,345 | | 6/1996 | Warner et al. | 424/402 |
| 5,538,595 | * | 7/1996 | Trokhan et al. | 162/158 |

FOREIGN PATENT DOCUMENTS

| | | |
|---|---|---|
| WO 95/16824 | 6/1995 | (WO) . |
| WO 96/24723 | 8/1996 | (WO) . |
| WO 97/30217 | 8/1997 | (WO) . |

* cited by examiner

*Primary Examiner*—Peter Chin
(74) *Attorney, Agent, or Firm*—Edward J. Milbrada; Donald E. Hasse; Tara M. Rosnell

(57) ABSTRACT

Strong, soft, and low dusting tissue paper webs useful in the manufacture of soft, absorbent sanitary products such as bath tissue, facial tissue, and absorbent towels are disclosed. At least one surface of the tissue papers has uniform discrete surface deposits of a substantively affixed chemical softening mixture comprising a mixture of a quartenary ammonium compound, an emollient, and a sorbitan ester.

34 Claims, 4 Drawing Sheets

TISSUE PAPER HAVING A SUBSTANTIVE ANHYDROUS SOFTENING MIXTURE DEPOSITED THEREON

TECHNICAL FIELD

This invention relates, in general, to tissue paper products. More specifically, it relates to tissue paper products containing surface-deposited chemical softening agents.

BACKGROUND OF THE INVENTION

Sanitary paper tissue products are widely used. Such items are commercially offered in formats tailored for a variety of uses such as facial tissues, toilet tissues and absorbent towels.

All of these sanitary products share a common need, specifically to be soft to the touch. Softness is a complex tactile impression evoked by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining such discharges for disposal in a sanitary fashion. Not surprisingly, the use of these products does not approach the level of cleanliness that can be achieved by more thorough cleansing methods, and producers of tissue and toweling products are constantly striving to make their products compete more favorably with thorough cleansing methods.

Shortcomings in tissue products for example cause many to stop cleaning before the skin is completely cleansed. Such behavior is prompted by the harshness of the tissue, as continued rubbing with a harsh implement can abrade the sensitive skin and cause severe pain. The alternative, leaving the skin partially cleansed, is chosen even though this often causes malodors to emanate and can cause staining of undergarments, and over time can cause skin irritations as well.

Disorders of the anus, for example hemorrhoids, render the perineal area extremely sensitive and cause those who suffer such disorders to be particularly frustrated by the need to clean their anus without prompting irritation.

Another notable case which prompts frustration is the repeated nose blowing necessary when one has a cold. Repeated cycles of blowing and wiping can culminate in a sore nose even when the softest tissues available today are employed.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been exploited in this regard has been to select and modify cellulose fiber morphologies and engineer paper structures to take optimum advantages of the various available morphologies. Applicable art in this area includes: Vinson et. al. in U.S. Pat. No. 5,228,954, issued Jul. 20, 1993, Vinson in U.S. Pat. No. 5,405,499, issued Apr. 11, 1995, Cochrane et al. in U.S. Pat. No. 4,874,465 issued Oct. 17, 1989, and Hermans, et. al. in U.S. Statutory Invention Registration H1672, published on Aug. 5, 1997, all of which disclose methods for selecting or upgrading fiber sources to tissue and toweling of superior properties. Applicable art is further illustrated by Carstens in U.S. Pat. No. 4,300,981, issued Nov. 17, 1981, which discusses how fibers can be incorporated to be compliant to paper structures so that they have maximum softness potential. While such techniques as illustrated by these prior art examples are recognized broadly, they can only offer some limited potential to make tissues truly effective comfortable cleaning implements.

Another area which has received a considerable amount of attention is the addition of chemical softening agents (also referred to herein as "chemical softeners") to tissue and toweling products.

As used herein, the term "chemical softening agent" refers to any chemical ingredient which improves the tactile sensation perceived by the consumer who holds a particular paper product and rubs it across the skin. Although somewhat desirable for towel products, softness is a particularly important property for facial and toilet tissues. Such tactile perceivable softness can be characterized by, but is not limited to, friction, flexibility, and smoothness, as well as subjective descriptors, such as a feeling like lubricious, velvet, silk or flannel which imparts a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine.

The second path is categorized by the addition of chemical softeners to tissue paper web after the web is dried. Applicable processes can be incorporated into the paper making operation as, for example, by spraying onto the dry web before it is wound into a roll of paper.

Exemplary art related to the former path categorized by adding chemical softeners to the tissue paper prior to its assembly into a web includes U.S. Pat. No. 5,264,082, issued to Phan and Trokhan on Nov. 23, 1993, incorporated herein by reference. Such methods have found broad use in the industry especially when it is desired to reduce the strength which would otherwise be present in the paper and when the papermaking process, particularly the creeping operation, is robust enough to tolerate incorporation of the bond inhibiting agents. However, there are problems associated with these methods, well known to those skilled in the art. First, the location of the chemical softener is not controlled; it is spread as broadly through the paper structure as the fiber furnish to which it is applied. In addition, there is a loss of paper strength accompanying use of these additives. While not being bound by theory, it is widely believed that the additives tend to inhibit the formation of fiber to fiber hydrogen bonds. There also can be a loss of control of the sheet as it is creped from the Yankee dryer. Again, a widely believed theory is that the additives interfere with the coating on the Yankee dryer so that the bond between the wet web and the dryer is weakened. Prior art such as U.S. Pat. No. 5,487,813, issued to Vinson, et. al., Jan. 30, 1996, incorporated herein by reference, discloses a chemical combination to mitigate the before mentioned effects on strength and adhesion to the creping cylinder; however, there still remains a need to incorporate a chemical softener into a paper web in a targeted fashion with minimal effect on web strength and interference with the production process.

Further exemplary art related to the addition of chemical softeners to the tissue paper web during its formation includes U.S. Pat. No. 5,059,282, issued to Ampulski, et. al. on Oct. 22, 1991 incorporated herein by reference. The Ampulski patent discloses a process for adding a polysiloxane compound to a wet tissue web (preferably at a fiber consistency between about 20% and about 35%). Such a method represents an advance in some respects over the addition of chemicals into the slurry vats supplying the papermaking machine. For example, such means target the application to one of the web surfaces as opposed to distributing the additive onto all of the fibers of the furnish. However, such methods fail to overcome the primary disadvantages of the addition of chemical softeners to the wet end of the papermaking machine, namely the strength effects and the effects on the coating of the Yankee dryer, should such a dryer be employed.

Because of the above mentioned effects on strength and disruption of the papermaking process, considerable art has been devised to apply chemical softeners to already-dried paper webs either at the so-called dry end of the papermaking machine or in a separate converting operation subsequent to the papermaking step. Exemplary art from this field includes U.S. Pat. No. 5,215,626, issued to Ampulski, et. al. on Jun. 1, 1993; U.S. Pat. No. 5,246,545, issued to Ampulski, et. al. on Sep. 21, 1993; and U.S. Pat. No. 5,525,345, issued to Warner, et. al. on Jun. 11, 1996, all incorporated herein by reference. The U.S. Pat. No. 5,215,626 Patent discloses a method for preparing soft tissue paper by applying a polysiloxane to a dry web. The U.S. Pat. No. 5,246,545 Patent discloses a similar method utilizing a heated transfer surface. Finally, the Warner Patent discloses methods of application including roll coating and extrusion for applying particular compositions to the surface of a dry tissue web. While each of these references represent advances over the previous so-called wet end methods particularly with regard to eliminating the degrading effects on the papermaking process, none are able to completely address the absorbency effects and loss of tensile strength which accompanies application to the dry paper web due to migration of the chemical softener.

Thus there is a need for continual improvements in chemical softening technology to reduce the migration of chemical softeners that are applied to an already dried web in order to mitigate the effects of such migration. Achieving a high softening potential without unduly affecting other web properties, such as absorbency and strength, has long been an object of workers in the field of the present application.

Accordingly, it is an object of the present invention to provide a soft tissue paper without performance impairing sacrifices such as in absorbency or in the strength of the paper.

This and other objects are obtained using the present invention as will be taught in the following disclosure.

SUMMARY OF THE INVENTION

The invention is a strong, soft tissue paper product comprised of one or more plies of tissue paper, wherein at least one outer surface of the product has a surface deposit of a substantively affixed chemical softening mixture, comprising a quartenary ammonium compound, an emollient, and a coupling agent.

The preferred embodiment of the present invention employs for the quaternary ammonium compound a dialkyldimethylammonium salts (e.g. ditallowdimethylammonium chloride, ditallowdimethylammonium methyl sulfate, di(hydrogenated tallow)dimethyl ammonium chloride, etc.). Particularly preferred variants of these compounds are what are considered to be mono or diester variations of the before mentioned dialkyldimethylammonium salts. These include so-called diester ditallow dimethyl ammonium chloride, diester distearyl dimethyl ammonium chloride, monoester ditallow dimethyl ammonium chloride, diester di(hydrogenated)tallow dimethyl ammonium methyl sulfate, diester di(hydrogenated)tallow dimethyl ammonium chloride, monoester di(hydrogenated)tallow dimethyl ammonium chloride, and mixtures thereof, with the diester variations of di(non hydrogenated)tallow dimethyl ammonium chloride, Di(Touch Hydrogenated)Tallow DiMethyl Ammonium Chloride (DEDTHTDMAC) and Di(Hydrogenated)Tallow DiMethyl Ammonium Chloride (DEDHIDMAC), and mixtures thereof being especially preferred. Depending upon the product characteristic requirements, the saturation level of the ditallow can be tailored from non hydrogenated (soft), to partially hydrogenated (touch), or completely hydrogenated (hard).

Preferred emollients include mineral oil, petrolatum, and silicones, with petrolatum being particularly preferred.

Preferred coupling agent have low HLB values. Particularly preferred coupling agents are the sorbitan esters of a fatty acid, e.g. sorbitan monostearate, as well as blends of the monoester with ethyloxylated forms thereof Most preferably, both sorbitan monostearate and ethoxylated sorbitan monostearate are present with a ratio of sorbitan monostearate to the ethoxylated sorbitan monostearate being preferably in the range of about 2:1 to about 4:1.

The preferred embodiment of the present invention is characterized by having uniform surface deposits of the softening mixture spaced apart at a frequency between about 1 deposit per lineal inch and about 100 deposits per lineal inch. Most preferably, the uniform surface deposits are spaced apart at a frequency between about 5 and about 25 deposits per lineal inch.

The term "frequency" in reference to the spacing of the deposits of chemical softener, as used herein, is defined as the number of deposits per lineal inch as measured in the direction of closest spacing. It is recognized that many patterns or arrangements of deposits qualify as being uniform and discrete and the spacing can be measured in several directions. For example, a rectilinear arrangement of deposits would be measured as having fewer deposits per inch in a diagonal line than on the horizontal and the vertical. Inventors believe that the direction of minimal spacing is the most significant and therefore define the frequency in that direction. A common engraving pattern is the so-called "hexagonal" pattern in which the recessed areas are engraved on centers residing on the corners of a equilateral hexagon with an additional recessed area in the center of the hexagonal figure. It is recognized that the closest spacing for this arrangement lies along a pair of lines intersecting each other at 60° and each intersecting a horizontal line at 60°. The number of cells per square area in a hexagonal arrangement is thus 1.15 times the square of the frequency.

Preferred embodiments of the present invention are further characterized by having the uniform surface deposits of the chemical softening agent predominantly residing on one or both of the two outer surfaces of the soft tissue paper product.

Finally, the invention is characterized by having less than about 50%, more preferably less than about 25%, and most preferably less than about 5% of the tissue surface covered by the chemical softener.

While not wishing to be bound by theory, inventors believe that the combination of the chemical softeners and the geometric parameters recited herein cause the softened tissue to illicit a surprising maximum in human tactile response resulting from the spacing of nerve sensors in human skin.

Preferred substantively affixed chemical softening agents comprise quaternary ammonium compounds including, but not limited to, the well-known dialkyldimethylammonium salts (e.g. ditallowdimethylammonium chloride, ditallowdimethylammonium methyl sulfate, di(hydrogenated tallow) dimethyl ammonium chloride, etc.). Particularly preferred variants of these softening agents are what are considered to be mono or diester variations of the before mentioned dialkyldimethylammonium salts. These include so-called diester ditallow dimethyl ammonium chloride, diester distearyl dimethyl ammonium chloride, monoester ditallow dimethyl ammonium chloride, diester di(hydrogenated) tallow dimethyl ammonium methyl sulfate, diester di(hydrogenated)tallow dimethyl ammonium chloride, monoester di(hydrogenated)tallow dimethyl ammonium chloride, and mixtures thereof, with the diester variations of di(non hydrogenated)tallow dimethyl ammonium chloride, Di(Touch Hydrogenated)Tallow DiMethyl Ammonium Chloride (DEDTHTDMAC) and Di(Hydrogenated)Tallow DiMethyl Ammonium Chloride (DEDHTDMAC), and mixtures thereof being especially preferred. Depending upon the product characteristic requirements, the saturation level of the ditallow can be tailored from non hydrogenated (soft), to partially hydrogenated (touch), or completely hydrogenated (hard).

The soft tissue paper of the present invention preferably has a basis weight between about 10 $g/m^2$ and about 100 $g/m^2$ and, more preferably, between about 10 $g/m^2$ and about 50 $g/m^2$. It has a density between about 0.03 $g/cm^3$ and about 0.6 $g/cm^3$ and, more preferably, between about 0.05 $g/cm^3$ and 0.2 $g/cm^3$.

The soft tissue paper of the present invention further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The tissue paper product of the present invention is preferably creped, i.e, produced on a papermaking machine culminating with a Yankee dryer to which a partially dried papermaking web is adhered and upon which it is dried and from which it is removed by the action of a flexible creping blade.

While the characteristics of the creped paper webs, particularly when the creping process is preceded by methods of pattern densification, are preferred for practicing the present invention, uncreped tissue paper is also a satisfactory substitute and the practice of the present invention using uncreped tissue paper is specifically incorporated within the scope of the present invention. Uncreped tissue paper, a term as used herein, refers to tissue paper which is non-compressively dried, most preferably by throughdrying. Resultant through air dried webs are pattern densified such that zones of relatively high density are dispersed within a high bulk field, including pattern densified tissue wherein zones of relatively high density are continuous and the high bulk field is discrete.

To produce uncreped tissue paper webs, an embryonic web is transferred from the formations forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The techniques to produce uncreped tissue in this manner are taught in the prior art. For example, Wendt, et. al. in European Patent Application 0 677 612A2, published Oct. 18, 1995 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped through air dried sheets. Finally, Farrington, et. al. in U.S. Pat. No. 5,656,132 published Aug. 12, 1997 and incorporated herein by reference, describes the use of a machine to make soft through air dried tissues without the use of a Yankee.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps.

Filler materials may also be incorporated into the tissue papers of the present invention. U.S. Pat. No. 5,611,890, issued to Vinson et al. on Mar. 18, 1997, the: disclosure of which is incorporated herein by reference, discloses filled tissue paper products acceptable as substrates for the present invention.

DETAILED DESCRIPTION OF THE INVENTION

Figure 1:
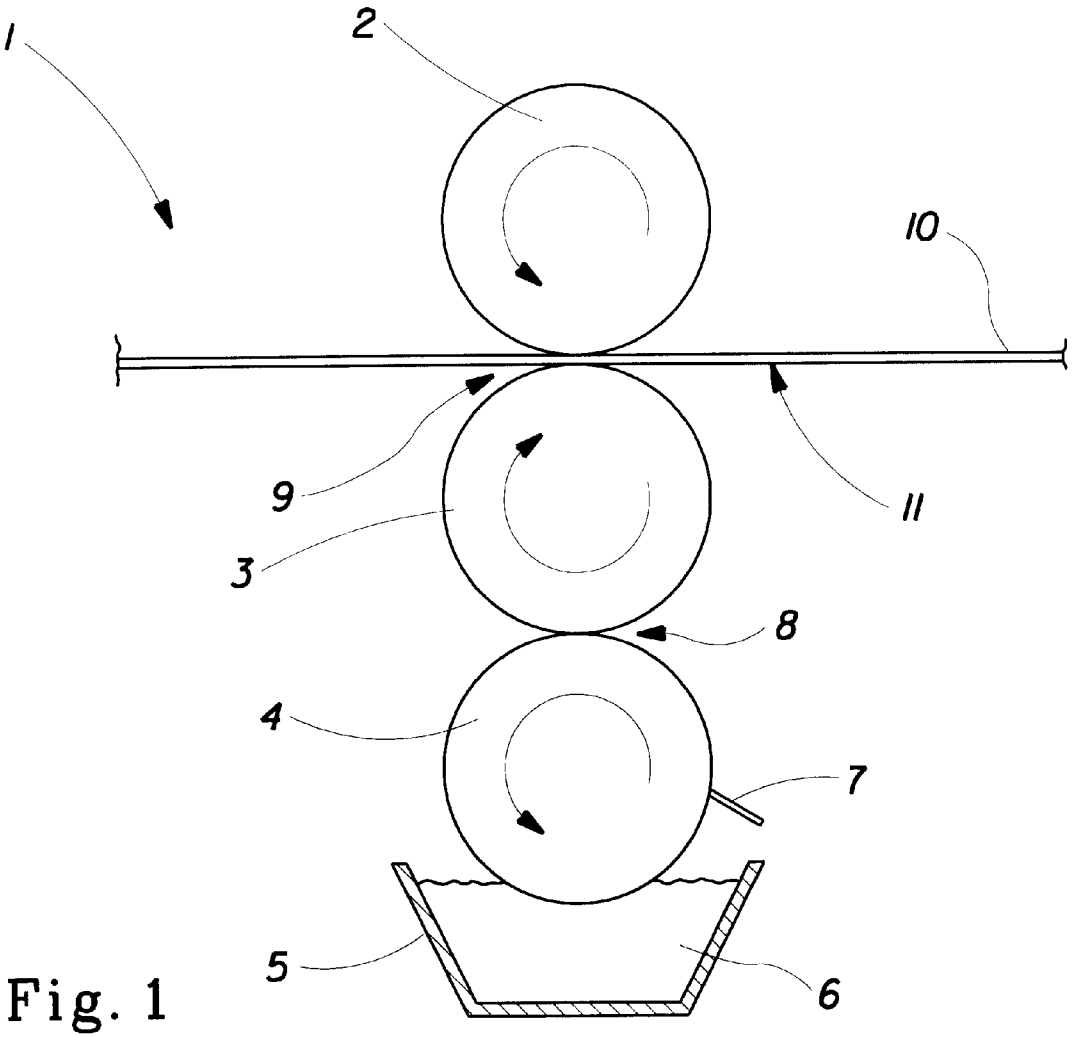
FIG. 1 is a side elevational view of a printing arrangement illustrating the preferred method of forming the uniform surface deposits of substantively affixed chemical softening agent of the present invention. The process illustrated in FIG. 1 applies the softening agent to one surface of the tissue paper product by an offset printing method.

While this specification concludes with claims particularly pointing out and distinctly claiming the subject matter regarded as the invention, it is believed that the invention can be better understood from a reading of the following detailed description and of the appended examples.

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "water soluble" refers to materials that are soluble in water to at least 3%, by weight, at 25° C.

As used herein, the terms "tissue paper web, paper web, web, paper sheet and paper product" all refer to sheets of paper made by a process comprising the steps of forming an aqueous papermaking furnish, depositing this furnish on a formations forming surface, such as a Fourdrinier wire, and removing the water from the furnish as by gravity or vacuum-assisted drainage, forming an embryonic web, transferring the embryonic web from the forming surface to a transfer surface or fabric upon which it is further dried using means known to the art, such as through air drying. The web may be still further dried to a final dryness using additional means, such as a Yankee dryer, after which it is wound upon a reel.

The terms "multi-layered tissue paper web, multi-layered paper web, multi-layered web, multi-layered paper sheet and multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless formations surfaces. If the individual layers are initially formed on separate formations surfaces, the layers can be subsequently combined when wet to form a multi-layered tissue paper web.

As used herein, the term "single-ply tissue product" means that it is comprised of one ply of tissue; the ply can be substantially homogeneous in nature or it can be a multi-layered tissue paper web. As used herein, the term "multi-ply tissue product" means that it is comprised of more than one ply of tissue. The plies of a multi-ply tissue product can be substantially homogeneous in nature or they can be multi-layered tissue paper webs.

Other terms are defined in the specification where initially discussed.

All percentages, ratios and proportions used herein are by weight unless otherwise specified.

General Description of the Soft Tissue Paper

The invention in its most general form, is a strong, soft tissue paper product comprised of one or more plies of tissue paper, wherein at least one outer surface of the product has surface deposits of a substantively affixed chemical softening mixture, comprising a quartenary ammonium compound, an emollient, and a coupling agent.

The preferred embodiment of the present invention is characterized by surface deposits which are uniform, discrete, and spaced apart at a frequency between about 1 deposit per lineal inch and about 100 deposits per lineal inch. Most preferably, the uniform surface deposits are spaced apart at a frequency between about 5 and about 25 deposits per line inch.

The uniform surface deposits of the chemical softening agent are preferably less than about 2700 microns in diameter, more preferably less than about 800 microns in diameter, and most preferably less than about 240 microns in diameter.

The present invention is further characterized by having the uniform surface deposits predominantly residing on at least one, and more preferably both, of the two outer surfaces of the tissue paper product.

General Description of the Chemical Softening Mixture

The chemical: softening mixture of the present invention has been found to impart desirable softness and lubricity to tissue substrates to which it is applied while, at the same time, minimizing the detrimental effects on absorbency and strength of chemical softening,compositions of the prior art. As used herein, the term "substantively affixed chemical softening mixture" is defined as a mixture which imparts lubricity or emolliency to tissue paper products and also possesses permanence with regard to maintaining the fidelity of its deposits without substantial migration when exposed to the environmental conditions to which products of this type are ordinarily exposed during their typical life cycle. Waxes and oils alone, for example, are capable of imparting lubricity or emolliency to tissue paper, but they suffer from a tendency to migrate because they have little affinity for the cellulose pulps which comprise the tissue papers of the present invention. While not wishing to be bound by theory, the Applicants believe that the components of the substantively affixed chemical mixture of the present invention interact with each other by Van der Waals forces, covalent bonding, ionic bonding, or hydrogen bonding or some combination thereof to minimize migration.

The Applicants have identified particularly desirable compositions comprising a mixture of a quaternary ammonium compound, an emollient and a coupling agent that provide such desirable lubricity and softness without substantial migration when such mixtures are applied to a tissue substrate at the levels described above. Suitable embodiments of such mixtures comprise between about 40% and about 80% of a quaternary ammonium compound; between about 10% and about 30% of an emollient; and between about 10% and about 20% of a coupling agent. Preferred embodiments comprise between about 50% and about 70% of a quaternary ammonium compound; between about 15% and about 25% of an emollient; and between about 12% and about 20% of a coupling agent. A particularly preferred mixture has the composition shown in Table 1.

TABLE 1

Particularly Preferred Chemical Softening Mixture

| Component | Percent by Weight |
|---|---|
| Quaternary Ammonium Compound | 60 |
| Emollient | 22 |
| Coupling Agent | 18 |

Each of the components of the chemical softening composition of the present invention is discussed in detail below.

Quaternary Ammonium Compounds

Preferably, the quaternary ammonium compounds of the present invention have the formula:

$$(R^1)_{4-m}—N^+—[R^2]_mX^-$$

wherein:

m is 1 to 3;

each $R^1$ is a $C_1$–$C_6$ alkyl group, hydroxyalkyl group, hydrocarbyl or substituted hydrocarbyl group, alkoxylated group, benzyl group, or mixtures thereof;

each $R^2$ is a $C_{14}$–$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

Preferably, each $R^1$ is methyl and $X^-$ is chloride or methyl sulfate. Preferably, each $R^2$ is $C_{16}$–$C_{18}$ alkyl or alkenyl, most preferably each $R^2$ is straight-chain $C_{18}$ alkyl or alkenyl. Optionally, the $R^2$ substituent can be derived from vegetable oil sources.

Such structures include dialkyldimethylammonium salts (e.g. ditallowdimethylammonium chloride, ditallowdimethylammonium methyl sulfate, di(hydrogenated tallow) dimethyl ammonium chloride, etc.), in which $R^1$ are methyl groups, $R^2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swem indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft), to partially hydrogenated (touch), or completely hydrogenated (hard). All of above-described levels of saturation are expressly meant to be included within the scope of the present invention.

Particularly preferred variants of these softening agents are what are considered to be mono or diester variations of these quaternary ammonium compounds having the formula:

$$(R^1)_{4-m}—N^+—[(CH_2)_n—Y—R^3]_mX^-$$

wherein:

Y is —O—(O)C—, or —C(O)—O—, or —NH—C(O)—, or —C(O)—NH—;

m is 1 to 3;

n is 0to 4;

each $R^1$ is a $C_1$–$C_6$ alkyl group, hydroxyalkyl group, hydrocarbyl or substituted hydrocarbyl group, alkoxylated group, benzyl group, or mixtures thereof;

each $R^3$ is a $C_{13}$–$C_{21}$ alkyl group, hydroxyalkyl group, hydrocarbyl or substituted hydrocarbyl group, alkoxylated group, benzyl group, or mixtures thereof, and $X^-$ is any softener-compatible anion.

Preferably, Y=—O—(O)C—, or —C(O)—O—; m=2; and n=2. Each $R^1$ substituent is preferably a $C_1$–$C_3$, alkyl group, with methyl being most preferred. Preferably, each $R^3$ is $C_{13}$–$C_{17}$ alkyl and/or alkenyl, more preferably $R^3$ is straight chain $C_{15}$–$C_{17}$ alkyl and/or alkenyl, $C_{15}$–$C_{17}$ alkyl, most preferably each $R^3$ is straight-chain $C_{17}$ alkyl. Optionally, the $R^3$ substituent can be derived from vegetable oil sources.

As mentioned above, $X^-$ can be any softener-compatible anion, for example, acetate, chloride, bromide, methyl sulfate, formate, sulfate, nitrate and the like can also be used in the present invention. Preferably $X^-$ is chloride or methyl sulfate.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft), to partially hydrogenated (touch), or completely hydrogenated (hard). All of above-described levels of saturation are expressly meant to be included within the scope of the present invention.

It will be understood that substituents $R^1$, $R^2$ and $R^3$ may optionally be substituted with various groups such as alkoxyl, hydroxyl, or can be branched. As mentioned above, preferably each $R^1$ is methyl or hydroxyethyl. Preferably, each $R^2$ is $C_{12}$–$C_{18}$ alkyl and/or alkenyl, most preferably each R2 is straight-chain $C_{16}$–$C_{18}$ alkyl and/or alkenyl, most preferably each $R^2$ is straight-chain C18 alkyl or alkenyl. Preferably $R^3$ is $C_{13}$–$C_{17}$ alkyl and/or alkenyl, most preferably $R^3$ is straight chain $C_{15}$– $C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g., $(R^1)_2$—$N^+$—$((CH_2)_2OH)$ $((CH_2)_2OC(O)R^3)$ $X^-$ as minor ingredients. These minor ingredients can act as emulsifiers and are useful in the present invention.

Other types of suitable quaternary ammonium compounds for use in the present invention are described in U.S. Pat. No. 5,543,067, Phan et al. issued Aug. 6, 1996; U.S. Pat. No. 5,538,595, Trokhan et al., issued on Jul. 23, 1996; U.S. Pat. No. 5,510,000, Phan et al., issued Apr. 23, 1996; U.S. Pat. No. 5415,737, Phan et al., issued May 16, 1995; and European Patent Application No. 0 688 901 A2, assigned to Kimberly-Clark Corporation, published Dec. 12, 1995; each of which is incorporated herein by reference.

Di-quat variations of the ester-functional quaternary ammonium compounds can also be used, and are meant to fall within the scope of the present invention. These compounds have the formula:

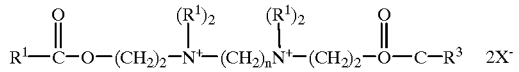

In the structure named above each $R^1$ is a $C_1$–$C_6$ alkyl or hydroxyalkyl group, $R^3$ is $C_{11}$–$C_{21}$ hydrocarbyl group, n is 2 to 4 and $X^-$ is a suitable anion, such as an halide (e.g., chloride or bromide) or methyl sulfate. Preferably, each $R^3$ is $C_{13}$–$C_{17}$ alkyl and/or alkenyl, most preferably each $R^3$ is straight-chain $C_{15}$–$C_{17}$ alkyl and/or alkenyl, and $R^1$ is a methyl.

Parenthetically, while not wishing to be bound by theory, it is believed that the ester moiety(ies) of the before mentioned quaternary compounds lends to them a measure of biodegradability. Importantly, the ester-functional quaternary ammonium compounds used herein biodegrade more rapidly than do conventional dialkyl dimethyl ammonium chemical softeners.

While such quaternary ammonium compounds provide desirable softening to tissue webs, use of such compounds also results in a reduction in the tensile properties of such webs. As noted above, such reduction in tensile properties is believed to be caused by an inhibition in the formation of fiber-to fiber hydrogen bonds due to the migration of the quaternary ammonium compound.

Emollient

The present invention is further characterized by the presence of an emollient. As used herein, an "emollient" is a material that softens, soothes, supples, coats, lubricates, or moisturizes the skin. An emollient typically accomplishes several of these objectives such as soothing, moisturizing, and lubricating the skin. Preferred emollients will have either a plastic or liquid consistency at ambient temperatures, i.e., 20° C. This particular emollient consistency allows the composition to impart a soft, lubricious, lotion-like feel.

Suitable emollients include petroleum based linear and branched alkanes and alkenes that are liquid or solid at a temperature of 20° C. and atmospheric pressure. Suitable petroleum-based emollients include those hydrocarbons, or mixtures of hydrocarbons, having chain lengths of from 16 to 32 carbon atoms. Petroleum based hydrocarbons having these chain lengths include mineral oil (also known as "liquid petrolatum") and petrolatum (also known as "mineral wax," "petroleum jelly" and "mineral jelly"). Mineral oil usually refers to less viscous mixtures of hydrocarbons having from 16 to 20 carbon atoms. Petrolatum usually refers to more viscous mixtures of hydrocarbons having from 16 to 32 carbon atoms. Petrolatum and mineral oil are particularly preferred emollients for compositions of the present invention. Petrolatum is a particularly preferred emollient because it imparts a highly desirable emolliency to tissue paper. A suitable material is available from Witco, Corp., Greenwich, Conn. as White Protopet® IS.

Other suitable types of emollients for use herein include polysiloxane compounds. In general, suitable polysiloxane materials for use in the present invention include those having monomeric siloxane units of the following structure:

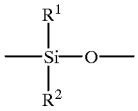

wherein, $R^1$ and R2, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R^1$ and $R^2$ radicals of any particular monomeric unit may differ from the corresponding functionalities of the next adjoining monomeric unit. Additionally, the polysiloxane can be either a straight chain, a branched chain or have a cyclic structure. The radicals $R^1$ and $R^2$ can additionally independently be other silaceous functionalities such as, but not limited to siloxanes, polysiloxanes, silanes, and polysilanes. The radicals $R^1$ and $R^2$ may contain any of a variety of organic functionalities including, for example, alcohol, carboxylic acid, phenyl, and amine functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary aralkyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotloyl, hexafluoroxylyl, and the like.

Preferred polysiloxanes include straight chain organopolysiloxane materials of the following general formula:

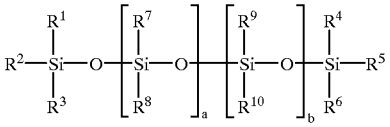

wherein each $R^1$–$R^9$ radical can independently be any $C_1$–$C_{10}$ unsubstituted alkyl or aryl radical, and $R^{10}$ of any substituted $C_1$–$C_{10}$ alkyl or aryl radical. Preferably each $R^1$–$R^9$ radical is independently any $C_1$–$C_4$ unsubstituted alkyl group. those skilled in the art will recognize that technically there is no difference whether, for example, $R^9$ or $R^{10}$ is the substituted radical. Preferably the mole ratio of b to (a+b) is between 0 and about 20%, more preferably between 0 and about 10%, and most preferably between about 1% and about 5%.

In one particularly preferred embodiment, $R^1$–$R^9$ are methyl groups and $R^{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R^{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R^{10}$ could be an amino functional or an aminoalkyl-functional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane can be rendered into a form which can be applied to the tissue paper product herein. This includes, but is not limited to, viscosity as low as about 25 centistokes to about 20,000,000 centistokes or even higher.

While not wishing to be bound by theory, it is believed that the tactile benefit efficacy is related to average molecular weight and that viscosity is also related to average molecular weight. Accordingly, due to the difficulty of measuring molecular weight directly, viscosity is used herein as the apparent operative parameter with respect to imparting softness to tissue paper.

References disclosing polysiloxanes include U.S. Pat. No. 2,826,551, issued to Geen on Mar. 11, 1958; U.S. Pat. No. 3,964,500, issued to Drakoff on Jun. 22, 1976; U.S. Pat. No. 4,364,837, issued to Pader on Dec. 21, 1982; U.S. Pat. No. 5,059,282, issued to Ampulski; U.S. Pat. No. 5,529,665 issued to Kaun on Jun 25, 1996; U.S. Pat. No. 5,552,020 issued to Smithe et al. on Sep. 3, 1996; and British Patent 849,433, published on Sep. 28, 1960 in the name of Wooston. All of these patents are incorporated herein by reference. Also incorporated herein by reference is Silicone Compounds, pp. 181–217, distributed by Petrach Systems, Inc., which contains an extensive listing and description of polysiloxanes in general.

Coupling Agent

While it provides desirable emolliency to tissue paper, when used alone, petrolatum can have a deleterious effect on absorbency. Also, as noted above, migration of quaternary ammonium compounds can result in a loss in tensile properties. Further, it tends to migrate easily over time. As noted above, the softening mixture is preferably provided in spaced apart surface deposits. Such spaced apart surface deposits address the absorbency effects of hydrophobic emollients, such as petrolatum, as long as the emollient does not migrate. Strength resins can also be used to mitigate the loss in tensile properties due to migration of a quaternary ammonium compound.

The Applicants have found that, by providing a coupling agent that associates with both the quaternary ammonium compound and the emollient of the present invention, migration of the quaternary ammonium compound and the emollient can be substantially reduced. The Applicants believe that a synergism results from the relationship of the quaternary ammonium compound, the emollient, and the coupling agent. The total composition has the desirable properties of each component, while minimizing any negative properties of the components. While not wishing to be bound by theory, the Applicants believe that polar head group of a suitable coupling agent can align with the polar nitrogen center of a quaternary ammonium compound producing a non-migratory mixture itself (so as to reduce loss of tensile properties) and concentrating their respective alkyl chains in a configuration which can entrap the emollient, preventing it from migrating while preserving its lubricating ability.

Suitable coupling agents are waxy or solid surface active materials, or blends of materials, having an HLB value of between about 2 and about 8. Preferably, the HLB value is between about 3 and about 7. More preferably the HLB value is between about 3.5 and about 6.

Suitable coupling agents for the present invention can comprise polyhydroxy fatty acid esters. Because of the skin sensitivity of those using paper products to which the softening mixture is applied, these esters should also be relatively mild and non-irritating to the skin.

Suitable polyhydroxy fatty acid esters for use in the present invention will have the formula:

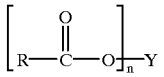

wherein:

R is a $C_5$–$C_{31}$ hydrocarbyl group, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof;

Y is a polyhydroxyhydrocarbyl moiety having a hydrocarbyl chain with at least 2 free hydroxyls directly connected to the chain; and n is at least 1.

Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan.

Suitable coupling agents can be selected from glyceryl or diglycerol monoesters of linear saturated $C_{14}$–$C_{24}$ fatty acids, such as glyceryl monopalmitate, glyceryl monobehenate, diglycerol monomyristate, diglycerol monostearate, and diglycerol monoesters of tallow fatty acids; sorbitan monoesters of linear saturated $C_{14}$–$C_{24}$ fatty acids, such as sorbitan monomyristate, sorbitan monostearate, and sorbitan monoesters derived from tallow fatty acids; diglycerol monoaliphatic ethers of linear saturated $C_{14}$–$C_{24}$ alcohols, and mixtures of these emulsifying components. Another class of suitable polyhydroxy fatty acid esters for use in the present invention comprise certain sucrose fatty acid esters, preferably the $C_{12}$–$C_{22}$ saturated fatty acid esters of sucrose. Sucrose monoesters are particularly preferred and include sucrose monostearate and sucrose monolaurate.

Diglycerol monoesters of linear saturated fatty acids useful as coupling agents in the present invention can be prepared by esterifying diglycerol with fatty acids, using procedures well known in the art. See, for example, the method for preparing polyglycerol esters disclosed in U.S. Pat. No. 5,387,207 (Dyer et al.) issued Feb. 7, 1995, which is incorporated by reference. Diglycerol can be obtained commercially or can be separated from polyglycerols that are high in diglycerol. Linear saturated fatty acids can be obtained commercially. The mixed ester product of the esterification reaction can be fractionally distilled under vacuum one or more times to yield distillation fractions that are high in diglycerol monoesters.

Sorbitan esters of linear saturated fatty acids can be obtained commercially or prepared using methods known in the art. See, for example, U.S. Pat. No. 4,103,047, issued to Zaki et al on Jul. 25, 1978, the disclosure of which is incorporated herein by reference The mixed sorbitan ester product can be fractionally vacuum distilled to yield compositions that are high in sorbitan monoesters.

A particularly preferred class of such coupling agents is sorbitan fatty acid esters.

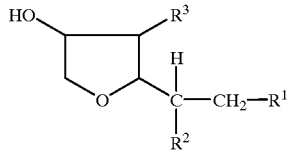

Wherein:

$R^1$ is a $C_{14}$–$C_{24}$ hydrocarbyl group;

$R^2$ is hydroxyl or a $C_{14}$–C24 hydrocarbyl group; and $R^3$ is hydroxyl or a $C_{14}$–C24 hydrocarbyl group.

Representative examples of suitable sorbitan esters include sorbitan palmitates (e.g., SPAN 40), sorbitan stearates (e.g., SPAN 60), and sorbitan behenates, that comprise one or more of the mono-, di- and tri-ester versions of these sorbitan esters, e.g., sorbitan mono-, di- and tri-palmitate, sorbitan mono-, di- and tri-stearate, sorbitan mono-, di and tri-behenate, as well as mixed tallow fatty acid sorbitan mono-, di- and tri-esters. Mixtures of different sorbitan esters can also be used, such as sorbitan palmitates with sorbitan stearates. Preferred sorbitan esters are the sorbitan stearates, typically as a mixture of mono-, di- and trimesters (plus some tetraester) such as SPAN 60, and sorbitan stearates sold under the trade name GLYCOMUL-S by Lonza, Inc. Although these sorbitan esters typically contain mixtures of mono-, di- and trimesters, plus some tetraester, the mono- and di-esters are usually the predominant species in these mixtures. A particularly preferred sorbitan ester is sorbitan monostearate ($R^1$=$C_{18}$ hydrocarbyl, $R^2$=hydroxyl, and $R^3$=hydroxyl).

Ethoxylated forms of the sorbitan fatty acid esters may also be added. They have the general formula:

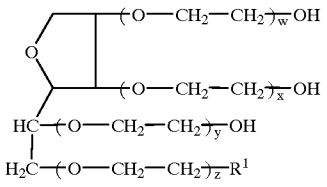

Wherein:

$R^1$ is a $C_{14}$–$C_{24}$ hydrocarbyl group; and w+x+y+z has an average value between about 5 and about 30.

Such ethoxylated sorbitan fatty acid esters are preferably blended with one of the preferred low HLB materials discussed above to formulate coupling agent compositions that can be tailored to more closely match the properties of the quaternary ammonium compound and the emollient. The ethyloxylated sorbitan ester may contain any number of ethylene oxide units with the most preferred range being from about 5 to about 30 moles per mole of the ethyloxylated sorbitan ester. Particularly preferred is sorbitan monostearate that has been ethoxylated with an average of 20 moles of ethylene oxide. An exemplary, commercially available material of this type is Tween 60 which is available from ICI Surfactants of Wilmington, Del.

When present, the ethoxylated sorbitan ester is preferably used at a relatively small fraction such that the ratio of sorbitan ester to ethoxylated sorbitan ester is from about 2:1 to about 4:1.

Tissue Paper

The soft tissue paper of the present invention preferably has a basis weight between about 10 g/m$^2$ and about 100 g/m$^2$ and, more preferably, between about 10 g/m$^2$ and about 50 g/m$^2$. It has a density between about 0.03 g/cm$^3$ and about 0.6 g/cm$^3$ and, more preferably, between about 0.05 g/cm$^3$ and 0.2 g/cm$^3$.

The preferred embodiment of the tissue paper of the present invention tissue further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The tissue paper product of the present invention is preferably creped, i.e., produced on a papermaking machine culminating with a Yankee dryer to which a partially dried papermaking web is adhered and upon which it is dried and from which it is removed by the action of a flexible creping blade.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large cylinder, generally 8–20 feet in diameter, which is designed to be pressurized with steam to provide a hot surface for completing the drying of papermaking webs at the end of the papermaking process. The paper web which is first formed on a formations forming carrier, such as a Fourdrinier wire, where it is freed of the copious water needed to disperse the fibrous slurry, is generally transferred to a felt or fabric in a so-called press section where de-watering is continued either by mechanically compacting the paper or by some other de-watering method such as through-drying with hot air, before finally being transferred in a semi-dry condition to the surface of the Yankee for the drying to be completed.

While the characteristics of the creped paper webs, particularly when the creping process is preceded by methods of pattern densification, are preferred for practicing the present invention, uncreped tissue paper is also a satisfactory substitute and the practice of the present invention using uncreped tissue paper is specifically incorporated within the scope of the present invention. Uncreped tissue paper, a term as used herein, refers to tissue paper which is non-compressively dried, most preferably by throughdrying. Resultant through air dried webs are pattern densified such that zones of relatively high density are dispersed within a high bulk field, including pattern densified tissue wherein zones of relatively high density are continuous and the high bulk field is discrete.

To produce uncreped tissue paper webs, an embryonic web is transferred from the formations forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The techniques to produce uncreped tissue in this manner are taught in the prior art. For example, Wendt, et. al. in European Patent Application 0 677 612A2, published Oct. 18, 1995 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped through air dried sheets. Finally, Farrington, et. al. in U.S. Pat. No. 5,656,132 published Aug. 12, 1997 and incorporated herein by reference, describes the use of a machine to make soft through air dried tissues without the use of a Yankee.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps.

It is anticipated that wood pulp in all its varieties will normally comprise the tissue papers with utility in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, Thermo Mechanical Pulp (TMP) and Chemi-ThermoMechanical Pulp (CTMP). Pulps derived from both deciduous and coniferous trees can be used.

Both hardwood pulps and softwood pulps as well as combinations of the two may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises the use of layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

It is anticipated that wood pulp in all its varieties will normally comprise the tissue papers with utility in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, Thermo Mechanical Pulp (TMP) and Chemi-ThermoMechanical Pulp (CTMP). Pulps derived from both deciduous and coniferous trees can be used.

Both hardwood pulps and softwood pulps as well as combinations of the two may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises the use of layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

Application of the Chemical Softening Mixture

FIGS. 1–4 are provided as an aid in describing the present invention. FIG. 1 is a side elevational view of a printing arrangement illustrating a preferred method of forming the uniform the surface deposits of substantively affixed chemical softening agent of the present invention. The process illustrated in FIG. 1 applies the softening agent to one surface of the tissue paper product by an offset printing method.

In FIG. 1, liquid chemical softener 6, preferably heated by means not shown, is contained in a pan 5, such that rotating gravure cylinder 4, also preferably heated by means not shown, is partially immersed in the liquid chemical softener 6. The gravure cylinder 4 has a plurality of recessed areas which are substantially void of contents when they enter pan 5, but fill with chemical softener 6 as the gravure cylinder 4 becomes partially immersed in the fluid in pan 5 during cylinder rotation. The gravure cylinder 4 and its pattern of recessed areas are illustrated hereinafter in FIG. 4 so a detailed description is delayed until it is provided in reference to that figure.

Still referring to FIG. 1, excess chemical softener 6 that is picked up from the pan 5 but is not held in the recessed areas is removed by a flexible doctor blade 7, which contacts gravure cylinder 4 on its outer surface, but is unable to significantly deform into the recessed areas. Hence, the remaining chemical softener on gravure cylinder 4 resides almost exclusively in the recessed areas of the gravure cylinder 4. This remaining chemical softener is transferred in the form of uniform discrete deposits to an applicator cylinder 3. Applicator cylinder 3 can have any of a variety of surface coverings provided they suit the purpose of the process. Most commonly, the cylinder will have a metallic covering. The gravure cylinder 4 and the applicator cylinder 3 normally will operate with interference since having a loading pressure will aid in extraction of the liquid chemical softener from the recessed areas of gravure cylinder 4 as they successively pass through the area 8 formed by the juxtaposition of the gravure cylinder 4 and the applicator cylinder 3. An interference or actual contact between the cylinder surfaces in area 8 is usually preferred, but it is envisioned that certain combinations of size and shape of recessed areas and chemical softener fluid characteristics might permit satisfactory transfer by merely having the two cylinders pass within close proximity. The chemical softener extracted in area 8 from the gravure cylinder 4 to the applicator cylinder 3 takes the form of surface deposits corresponding in size and spacing to the pattern of recessed areas of the gravure cylinder 4. The deposits of chemical softener on the applicator cylinder 3 transfer to tissue paper web 1, which is directed towards area 9, a area defined by the point at which the applicator cylinder 3, tissue paper web 1, and impression cylinder 2 are in the vicinity of one another. Impression cylinder 2 can have any of a variety of surface coverings provided they suit the purpose of the process. Most commonly, the cylinder will be covered with a compressible covering such as an elastomeric polymer such as a natural or synthetic rubber. The impression cylinder 2 and the applicator cylinder 3 normally will operate without interfering. It is only necessary to have the cylinders pass sufficiently close to one another such that when the tissue web is present in area 9, the tissue web contacts with the proud deposits of chemical softener on applicator cylinder 3 sufficiently to cause them to at least partially be transferred from the applicator cylinder 3 to the tissue web 1. Since loading pressure between applicator cylinder 3 and impression cylinder 2 will tend to compress tissue web 1, excessively small gaps between the two cylinders should be avoided in order to preserve the thickness or bulk of tissue web 1. An interference between the cylinder surfaces (through tissue paper web 1) in area 9 is usually not necessary, but it is envisioned that certain combinations of patterns and chemical softener fluid characteristics might require that the two cylinders be operated so as to be in interference. The tissue paper web 1 exits area 9 with side 11 containing uniform surface deposits of substantively affixed softening agent according to the pattern of gravure cylinder 4.

Figure 2:
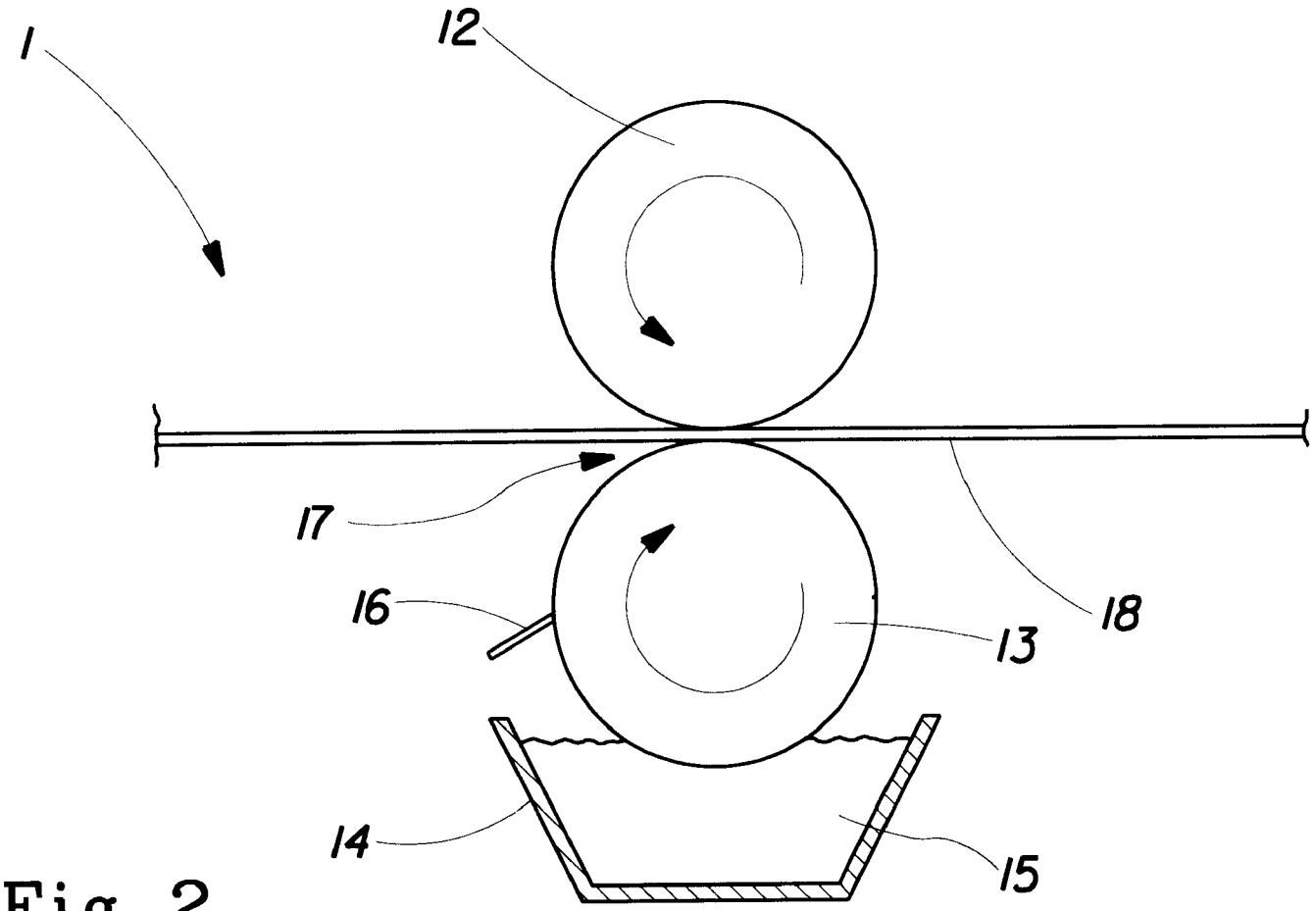
FIG. 2 is a side elevational view of a printing arrangement illustrating an alternate method of forming the uniform surface deposits of substantively affixed chemical softening agent of the present invention. The process illustrated in FIG. 2 applies the softening agent to one surface of the tissue paper product by a direct printing method.

FIG. 2 is a side elevational view of a printing arrangement illustrating an alternate method of forming the uniform surface deposits of substantively affixed chemical softening agent of the present invention. The process illustrated in FIG. 2 applies the softening agent to one surface of the tissue paper product by a direct printing method.

In FIG. 2, a liquid chemical softener 15, preferably heated by means not shown, is contained in a pan 14, such that rotating gravure cylinder 13, also preferably heated by means not shown, is partially immersed in the liquid chemical softener 15. The gravure cylinder 13 has a plurality of recessed areas which are substantially void of contents when they enter the pan 14, but fill with chemical softener 15 while immersed in pan 14 as the gravure cylinder 13 becomes partially immersed with its rotation. The gravure cylinder 13 and its pattern of recessed areas are illustrated herein after in FIG. 4 so a detailed description is deferred until it is provided in reference to that Figure.

Referring again to FIG. 2, excess chemical softener 15 that is picked up from the pan 14 but not held in the recessed areas, is removed by a flexible doctor blade 16, which contacts gravure cylinder 13 on its outer surface, but is unable to significantly deform into the recessed areas. Hence, the remaining chemical softener on gravure cylinder 13 resides almost exclusively in the recessed areas of the gravure cylinder 13. This remaining chemical softener is transferred in the form of uniform discrete deposits to a tissue paper web 1, which is directed towards area 17. The transfer occurs because the tissue web 1 is brought into the vicinity of the chemical softener present in the recessed areas due to the constraint of impression cylinder 12 relative to gravure cylinder 13 in area 17. Impression cylinder 12 can have any of a variety of surface coverings provided they suit the purpose of the process. Most commonly, the cylinder will be covered with a compressible covering such as an elastomeric polymer such as a natural or synthetic rubber. The gravure cylinder 13 and the impression cylinder 12 normally will operate with interference, i.e. be in contact through tissue paper web 1, since having a loading pressure will aid in extraction of the liquid chemical softener from the recessed areas of gravure cylinder 13 as they successively pass through the area 17 formed by the interference of the gravure cylinder 13, the tissue paper web 1 and the impression cylinder 12. An interference transmitted through tissue paper web 1 in area 17 is usually preferred, but it is envisioned that certain combinations of size and shape of recessed areas and chemical softener fluid characteristics might permit satisfactory transfer by merely having the two cylinders and confined tissue web pass within close proximity. The tissue paper web 1 exits area 17 with side 18 containing uniform discrete surface deposits of substantively affixed softening agent according to the pattern of gravure cylinder 14.

Figure 3:
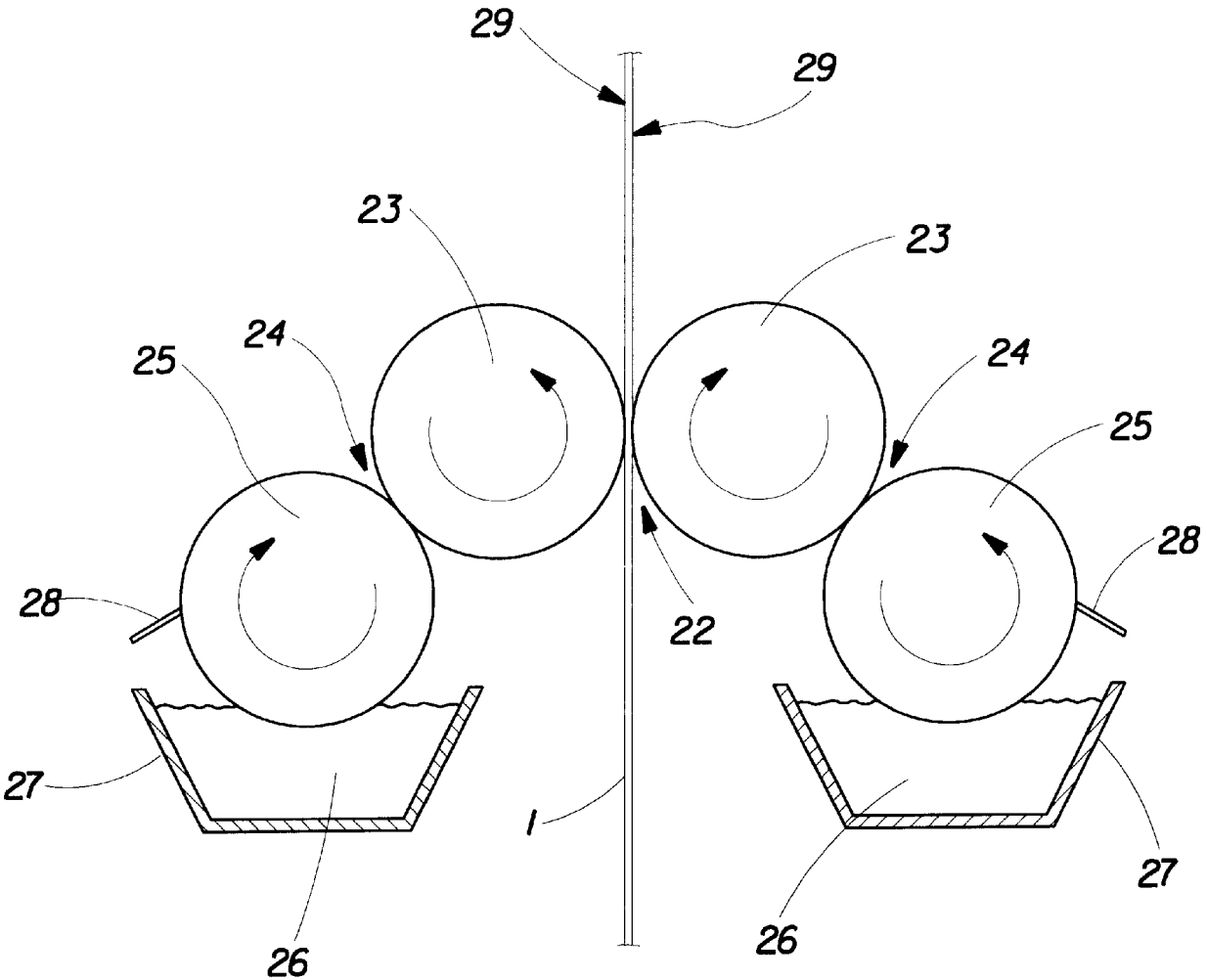
FIG. 3 is a side elevational view of a printing arrangement illustrating another alternate method of forming the uniform surface deposits of substantively affixed chemical softening agent of the present invention. The process illustrated in FIG. 3 applies the softening agent to both surfaces of the tissue paper product by an offset printing method.

FIG. 3 is a side elevational view of a printing arrangement illustrating another alternate method of forming the uniform surface deposits of substantively affixed chemical softening agent of the present invention. The process illustrated in FIG. 3 applies the softening agent to both surfaces of the tissue paper product by an offset printing method.

In FIG. 3, liquid chemical softener 26, preferably heated by means not shown, is contained in pans 27, such that the rotating gravure cylinders 25, also preferably heated by means not shown, are partially immersed in chemical softener 26. The gravure cylinders 25 have a plurality of recessed areas which are substantially void of contents when they enter their respective pans 27, but fill with chemical softener 26 while immersed in pans 27 as the gravure cylinders 25 become partially immersed in them with their rotation. The gravure cylinders 25 and their pattern of recessed areas are illustrated hereinafter in FIG. 4 so a detailed description is deferred until it is provided in reference to that Figure. The gravure cylinders 25 of FIG. 3 will ordinarily be similar in design, but they can also be deliberately varied especially in regards to the pattern of recessed areas. Differences can be used to tailor the characteristics of the product from side to side.

Still referring to FIG. 3, excess chemical softener 26 that is picked up from the pans 27 but not held in the recessed areas is removed by a flexible doctor blades 28, which contact gravure cylinders 25 on their outer surfaces, but are unable to significantly deform into the recessed areas. Hence, the remaining chemical softener on gravure cylinder 25 resides almost exclusively in the recessed areas of the gravure cylinders 25. This remaining chemical softener is transferred in the form of uniform discrete deposits to applicator cylinders 23. Applicator cylinders 23 can have any of a variety of surface coverings provided they suit the purpose of the process. Most commonly, the cylinder will be covered with compressible coverings such as an elastomeric polymer such as a natural or synthetic rubber. Usually, the cylinders 23 will be similar in nature, but they can differ as well to create different characteristics of the product from side to side. Each pair of gravure cylinders 25 with its respective applicator cylinders 23 normally will operate in interference since having a loading pressure between the cylinder pairs will aid in extraction of the liquid chemical softener from the recessed areas of gravure cylinders 25 as they successively pass through their respective interference areas 24 formed by the interference of the gravure cylinders 25 with their respective applicator cylinders 23. Interference or actual contact between the cylinder surfaces in one or both of the areas 24 is usually preferred, but it is envisioned that certain combinations of size and shape of recessed areas and chemical softener fluid characteristics might permit satisfactory transfer by merely having the one or more of the cylinder pairs pass within close proximity. The chemical softener extracted in the areas 24 from the gravure cylinders 25 to the applicator cylinders 23 takes the form of surface deposits corresponding in size and spacing to the pattern of recessed areas of the gravure cylinders 25. The deposits of chemical softener on the applicator cylinders 23 transfer to tissue paper web 1, which is directed towards area 22, as the deposits of chemical softener passes through the area 22. Area 22 is formed by the applicator cylinders 23 at their most proximate point with tissue paper web 1 passing between the applicator cylinders 23. The applicator cylinders 23 normally will operate without interfering, i.e. touching, one another. Provided the cylinders pass sufficiently close to one another such that when the tissue web is present in area 22, that it contacts with the chemical softener deposits on each of the applicator cylinders 23 sufficiently to cause the deposits to at least partially be transferred from the applicator cylinders 23 to the tissue web 1. Since loading pressure between applicator cylinders 23 will tend to compress tissue web 1, excessively small gaps between the two cylinders should be avoided in order to preserve the thickness or bulk of tissue web 1. An interference or actual contact between the cylinder surfaces (through tissue paper web 1) in area 22 is usually not necessary, but it is envisioned that certain combinations of patterns and chemical softener fluid characteristics might require that the two cylinders be operated in interference. The tissue paper web 1 exits area 22 with both sides 29 having uniform discrete surface deposits of substantively affixed softening agent according to the pattern of gravure cylinders 25.

Figure 4:
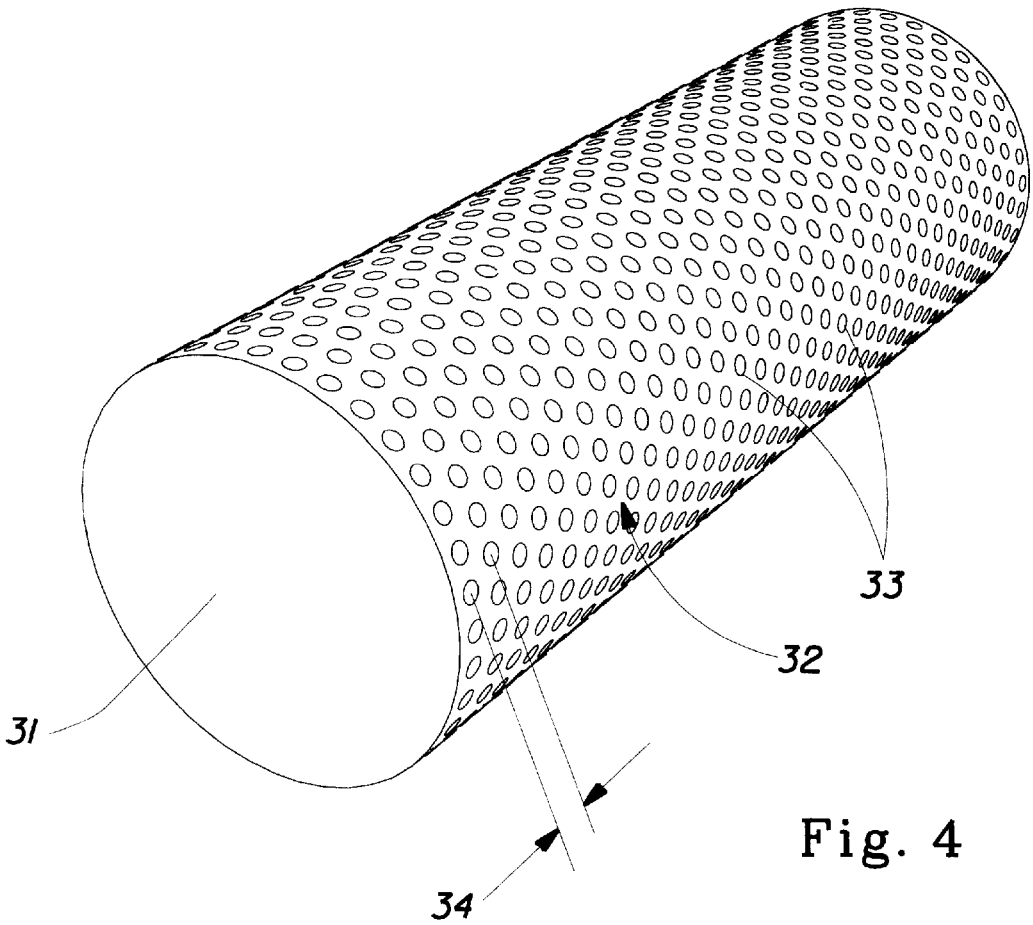
FIG. 4 is a schematic representation illustrating the detail of the recessed areas for use on the printing cylinders illustrated in FIGS. 1, 2, and 3.

FIG. 4 is a schematic representation illustrating the detail of the recessed areas for use on the printing cylinders illustrated in FIGS. 1,2, and 3, i.e. gravure cylinder 4 of FIG. 1, gravure cylinder 13 of FIG. 2, and gravure cylinders 25 of FIG. 3. Referring to FIG. 4, the gravure cylinder 31 possesses a plurality of recessed areas sometimes referred to as cells. The recessed areas 33 exist on an otherwise smooth cylindrical surface 32.

The cylinder 31 may be comprised of a variety of materials. In general, it will be relatively non-compressible in nature such as a metallic or ceramic roll, but elastomeric roll coverings are possible as well. Most preferably, the surface of the cylinder 31 is ceramic such as aluminum oxide. This permits the creation of the plurality of recessed areas by engraving them by directing an intense laser beam at the surface as is well known in the process printing industry.

An alternate means of creating the recessed areas on cylinder 31 is to electromechanically engrave them using an electronically controlled oscillation of a diamond tipped cutting tool. When this method is selected, it is most convenient to surface the roll with copper until it is engraved and then to plate a thin chrome finish to protect the soft copper layer.

Another alternate means of creating the recessed areas on cylinder 31 is to chemically etch them using a labile roll surface protected by a chemically resistant mask secured on the rolls surface to prevent etching in the areas not intended to become recessed areas 33. When this method is selected, it is again most convenient to surface the roll with copper until it is etched and then to plate a thin chrome finish to protect the soft copper layer.

Finally, yet another alternate means of creating the recessed areas on cylinder 31 is to mechanically engrave them using a knurled cutting tool. This method permits the widest variety of materials of construction for the cylinder but suffers from little possible variation in the achievable patterns.

The separation distance 34 of the recessed cells 33 on the cylindrical surface 32 ranges from five recessed areas per inch to 100 recessed areas per inch. Each recessed cell 33 preferably has an approximately hemispherical geometry.

Figure 4A:
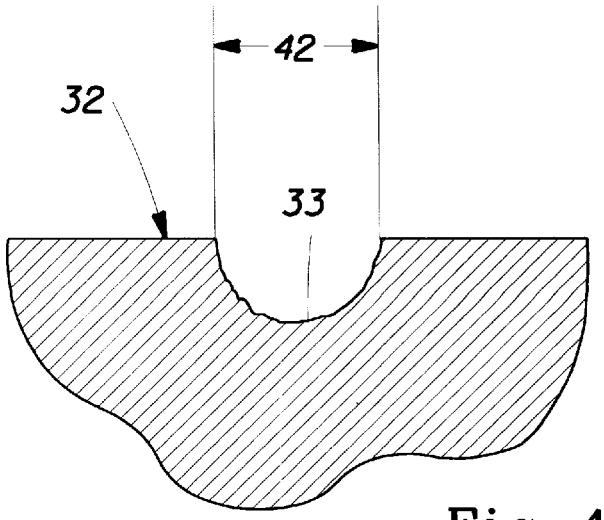
FIG. 4A provides further detail of the recessed areas preferred for use in the present invention by illustrating one of the recessed areas in a cross sectional view.

FIGS. 4 and 4A provides further detail of the recessed cells 33 preferred for use in the present invention by illustrating one of the recessed cells 33 in a cross sectional view. As shown in FIG. 4A, a portion of the gravure cylinder surface 32 contains a roughly hemispherical recessed cell 33 having a diameter 42 ranging from about 50 microns to about 500 microns, preferably from about one hundred and thirty microns to about four hundred and ten microns. As is shown FIG. 4, there is a plurality of such cells 33 throughout the surface 32 of the cylinder 31.

Optional Furnish Components and Web Structures

Furnish Components

Other materials can be added to the aqueous papermaking furnish or the embryonic web to impart other characteristics to the product or improve the papermaking process so long as they are compatible with the chemistry of the substantively affixed softening agent and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One example material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993, incorporated herein by reference. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Polyamide-epichlorohydrin resins are cationic wet strength resins which have been, found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of useful polyamide-epichlorohydrin resins is Hercules, Inc. of Wilmington, Del., which markets such resin under the mark Kymene 557H®.

Many paper products must have limited strength when wet because of the need to dispose of them through toilets into septic or sewer systems. If wet strength is imparted to these products, it is preferred to be fugitive wet strength characterized by a decay of part or all of its potency upon standing in presence of water. If fugitive wet strength is desired, the binder materials can be chosen from the group consisting of dialdehyde starch or other resins with aldehyde functionality such as Co-Bond 1000® offered by National Starch and Chemical Company, Parez 750® offered by Cytec of Stamford, Conn. and the resin described in U.S. Pat. No. 4,981,557 issued on Jan. 1, 1991, to Bjorkquist and incorporated herein by reference.

If enhanced absorbency is needed, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40® which is available from Croda, Inc. (New York, N.Y.); alkylglycoside ethers as described in U.S. Pat. No. 4.011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.).

While the essence of the present invention is the presence of a substantively affixed chemical softening composition deposited in the form of uniform and discrete deposits on the surface of the tissue paper web, the invention also expressly includes variations in which chemical softening agents are added as a part of the papermaking process. Acceptable chemical softening agents comprise the well known dialkyldimethylammonium salts such as ditallowdimethylammonium chloride, ditallowdimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename Varisoft 137®. Biodegradable mono and di-ester variations of the quaternary ammonium compound can also be used and are within the scope of the present invention.

Filler materials may also be incorporated into the tissue papers of the present invention. U.S. Pat. No. 5,611,890, issued to Vinson et al. on Mar. 18, 1997, the disclosure of which is incorporated herein by reference, discloses filled tissue paper products acceptable as substrates for the present invention.

The above listings of optional chemical additives is intended to be merely exemplary in nature, and are not meant to limit the scope of the invention.

Web Structures

The tissue paper webs made according to the present invention may have a basis weight of between 10 g/m$^2$ and about 100 g/m$^2$. In its preferred embodiment, the tissue paper made by the present invention has a basis weight between about 10 g/m$^2$ and about 100 g/m$^2$ and, most preferably, between about 10 g/m$^2$ and about 50 g/m$^2$. Tissue paper webs prepared by the present invention possess a density of about 0.60 g/cm$^3$ or less. In its preferred embodiment, the tissue paper of the present invention has a density between about 0.03 g/cm$^3$ and about 0.6 g/cm$^3$ and, most preferably, between about 0.05 g/cm$^3$ and 0.2 g/cm$^3$.

The present invention is further applicable to the production of multi-layered tissue paper webs. Multilayered tissue structures and methods of forming multilayered tissue structures are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference. The layers are preferably comprised of different fiber types, the fibers typically being relatively long softwood and relatively short hardwood fibers as used in multi-layered tissue paper making. Multi-layered tissue paper webs resultant from the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fibers having an average fiber length of least about 2.0 mm. These long paper making fibers are typically softwood fibers, preferably, northern softwood Kraft fibers. Preferably, the majority of the particulate filler of the present invention is contained in at least one of the outer layers of the multi-layered tissue paper web of the present invention. More preferably, the majority of the particulate filler of the present invention is contained in both of the outer layers.

The tissue paper products made from single-layered or multi-layered tissue paper webs can be single-ply tissue products or multi-ply tissue products.

In typical practice of the present invention, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering.

To prepare tissue paper products with utility in the present invention, an aqueous papermaking furnish is deposited on a formations surface to form an embryonic web. The scope of the invention also includes processes for making tissue paper product by the formation of multiple paper layers in which two or more layers of furnish are preferably formed from the deposition of separate streams of dilute fiber slurries for example in a multi-channeled headbox. The layers are preferably comprised of different fiber types, the fibers typically being relatively long softwood and relatively short hardwood fibers as used in multi-layered tissue paper making. If the individual layers are initially formed on separate wires, the layers are subsequently combined when wet to form a multi-layered tissue paper web. The papermaking fibers are preferably comprised of different fiber types, the fibers typically being relatively long softwood and relatively short hardwood fibers. More preferably, the hardwood fibers comprise at least about 50% and said softwood fibers comprise at least about 10% of said papermaking fibers.

The term "strength" as used herein refers to the specific total tensile strength, the determination method for this measure is included in a later section of this specification. The tissue paper webs according to the present invention are strong. This generally means that their specific total tensile strength is at least about 200 grams per inch, more preferably more than about 300 grams per inch.

The terms "lint" and "dust" are used interchangeably herein and refer to the tendency of a tissue paper web to release fibers or particulate fillers as measured in a controlled abrasion test, the methodology for which is detailed in a later section of this specification. Lint and dust are related to strength since the tendency to release fibers or particles is directly related to the degree to which such fibers or particles are anchored into the structure. As the overall level of anchoring is increased, the strength will be increased. However, it is possible to have a level of strength which is regarded as acceptable but have an unacceptable level of linting or dusting. This is because linting or dusting can be localized. For example, the surface of a tissue paper web can be prone to linting or dusting, while the degree of bonding beneath the surface can be sufficient to raise the overall level of strength to quite acceptable levels. In another case, the strength can be derived from a skeleton of relatively long papermaking fibers, while fiber fines or the particulate filler can be insufficiently bound within the structure. The tissue paper webs of the present invention are relatively low in lint. Levels of lint below about 12 are preferable, and below about 10 are more preferable.

The multi-layered tissue paper webs of to the present invention can be used in any application where soft, absorbent multi-layered tissue paper webs are required. Particularly advantageous uses of the multi-layered tissue paper web of this invention are in toilet tissue and facial tissue products. Both single-ply and multi-ply tissue paper products can be produced from the webs of the present invention.

TEST METHODS

Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

Measurement of Tissue Paper Lint

The amount of lint generated from a tissue product is determined with a Sutherland Rub Tester. This tester uses a motor to rub a weighted felt 5 times over the stationary toilet tissue. The Hunter Color L value is measured before and after the rub test. The difference between these two Hunter Color L values is calculated as lint.

Sample Preparation

Prior to the lint rub testing, the paper samples to be tested should be conditioned according to TAPPI Method #T402OM-88. Here, samples are preconditioned for 24 hours at a relative humidity level of 10 to 35% and within a temperature range of 22 to 40° C. After this preconditioning step, samples should be conditioned for 24 hours at a relative humidity of 48 to 52% and within a temperature range of 22 to 24° C. This rub testing should also take place within the confines of the constant temperature and humidity room.

The Sutherland Rub Tester may be obtained from Testing Machines, Inc. (Amityville, N.Y.). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the wire side out and 3 with the non-wire side out. Keep track of which samples are wire side out and which are non-wire side out.

Obtain a 30"×40" piece of Crescent #300 cardboard from Cordage Inc. of Cincinnati, Ohio. Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn. Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip.

If working with multi-ply converted product, there will now be 3 samples on the cardboard. For single-ply finished product, there will now be 3 wire side out samples on cardboard and 3 non-wire side out samples on cardboard.

Felt Preparation

Obtain a 30"×40" piece of Crescent #300 cardboard from Cordage Inc. of Cincinnati, Ohio. Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket of Bristol, Conn.) to the dimensions of 2.25"×8.5"×0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor. Obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "W." Mark the next highest number with the letter "N." Continue marking the samples in this alternating "W"/"N" pattern. Use the "W" samples for wire side out lint analyses and the "N" samples for non-wire side lint analyses. For 1-ply product, there are now a total of 24 samples for the new lot of felt and the old lot of felt. Of this 24, twelve are for wire side out lint analysis and 12 are for non-wire side lint analysis.

Rub and measure the Hunter Color L values for all 24 samples of the old felt as described below. Record the 12 wire side Hunter Color L values for the old felt. Average the 12 values. Record the 12 non-wire side Hunter Color L values for the old felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 wire side Hunter Color L values for the new felt. Average the 12 values. Record the 12 non-wire side Hunter Color L values for the new felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

Measurement of Samples

The first step in the measurement of lint is to measure the Hunter color values of the black felt/cardboard samples prior to being rubbed on the tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboard using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboard is used until they are bent, torn, limp, or no longer have a smooth surface.

Calculations

Determine the delta L values by subtracting the average initial L reading found for the unused felts from each of the measured values for the wire side and the non-wire side of the sample. Recall, multi-ply-ply product will only rub one side of the paper. Thus, three delta L values will be obtained for the multi-ply product. Average the three delta L values and subtract the felt factor from this final average. This final result is termed the lint for the 2-ply product.

For the single-ply product where both wire side and non-wire side measurements are obtained, subtract the average initial L reading found for the unused felts from each of the three wire side L readings and each of the three non-wire side L readings. Calculate the average delta for the three wire side values. Calculate the average delta for the three non-wire side values. Subtract the felt factor from each of these averages. The final results are termed a lint for the non-wire side and a lint for the wire side of the single-ply product. By taking the average of these two values, an ultimate lint is obtained for the entire single-ply product.

Panel Softness of Tissue Papers

Ideally, prior to softness testing, the paper samples to be tested should be conditioned according to TAPPI Method #T402OM-88. Here, samples are preconditioned for 24 hours at a relative humidity level of 10 to 35% and within a temperature range of 22 to 40° C. After this preconditioning step, samples should be conditioned for 24 hours at a relative humidity of 48 to 52% and within a temperature range of 22 to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are preformed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Strength of Tissue Papers

Dry Tensile Strength

The tensile strength is determined on one inch wide strips of sample using a Thwing-Albert Intelect II Standard Tensile Tester, available from Thwing-Albeit Instrument Co. of Philadelphia, Pa. This method is intended for use on finished paper products, reel samples, and unconverted stocks.

Sample Conditioning and Preparation

Prior to tensile testing, the paper samples to be tested should be conditioned according to TAPPI Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of the constant temperature and humidity room.

For finished product, discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield available from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1" wide strips in the machine direction from stacks 1 and 3. Cut two "1" wide strips in the cross direction from stacks 2 and 4. There are now four 1" wide strips for machine direction tensile testing and four 1" wide strips for cross direction tensile testing. For these finished product samples, all eight 1" wide strips are five usable units (also termed sheets) thick.

For unconverted stock and/or reel samples, cut a 15" by 15" sample which is 8 plies thick from a region of interest of the sample using a paper cutter (JDC-1-10 or JDC-1-12 with safety shield available from Thwing-Albert Instrument Co. of Philadelphia, Pa.). Make sure one 15" cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15" by 15" sample which is 8 plies thick, cut four strips 1" by 7" with the long 7" dimension running parallel to the machine direction.

Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield available from Thwing-Albert Instrument Co. of Philadelphia, Pa.). There are now a total of eight samples: four 1" by 7" strips which are 8 plies thick with the 7" dimension running parallel to the machine direction and four 1" by 7" strips which are 8 plies thick with the 7" dimension running parallel to the cross direction.

Operation of Tensile Tester

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 2.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

Calculations

For the four machine direction 1" wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

EXAMPLES

The following examples are offered to illustrate the practice of the present invention. These examples are intended to aid in the description of the present invention, but, in no way, should be interpreted as limiting the scope thereof The present invention is bounded only by the appended claims.

Example 1

This example illustrates the use of an offset roto-gravure printer to prepare a two-ply bath tissue having uniform discrete deposits of a substantively affixed chemical softening mixture on one of its exterior surfaces.

Materials used to prepare the softening composition are:

1. Tallow diester chloride quaternary ammonium compound (ADOGEN SDMC) available from WITCO Chemical Company of Greenwich, Conn.
2. Petrolatum (White Protopet 1S) from WITCO Chemical Company of Greenwich, Conn.
3. Sorbitan monostearate (Span 60 from ICI Surfactants, Inc. of Wilmington, Del.).
4. Ethoxylated sorbitan monostearate (Tween 60 from ICI Surfactants, Inc. of Wilmington, Del.).

The softening composition is prepared by weighing appropriate amounts of each of the above identified materials, melting them and mixing them in a constant temperature vessel held at 140° F. to prepare a composition comprising: 60% tallow diester chloride quaternary ammonium compound, 22% petrolatum, 14% sorbitan monostearate, and 4% ethyloxylated sorbitan monostearate. The softening composition is then fed to a gravure pan that allows the softening composition to fill the recessed areas of the rotating gravure cylinder.

The gravure cylinder construction includes a central void area suitable for circulation of a heating fluid to maintain the surface of the roller at approximately 140° F. The surface of the gravure cylinder is clad with an aluminum oxide ceramic into which the recessed areas are engraved by a laser technique. The recessed areas are hemispherically shaped; each area having a diameter of about 400 $\mu$ and therefore a depth of about 200 $\mu$. The pattern of the recessed areas is hexagonal and frequency of the recessed areas is 10 per lineal inch, such that there are 115 areas per square inch. The resultant percentage of total area covered by recessed areas is about 2.2%.

The excess softener composition is doctored from the surface of the gravure cylinder by a flexible polytetrafluoroethylene doctor blade.

The offset printer is operated such that the surface speed of its cylinders and therefore the web speed is 300 feet per minute.

The offset printer is operated such that the surface speed of its cylinders and therefor e the web speed is 300 fee t per minute.

The gravure cylinder is operated in contact with an applicator cylinder. The applicator cylinder has a rubber covering of 50 P&J hardness. The two cylinders are loaded into interference such that the width of area of contact of the two cylinders by virtue of the deformation of the rubber covering on the applicator cylinder is 5/32 of an inch. The softening composition thus transfers from the gravure cylinder to the applicator cylinder.

The applicator cylinder is operated in proximity with an impression cylinder. The impression cylinder is of steel construction. The cylinders are loaded to stops such that a gap of 7 mil exists between the two cylinders.

A two-ply bath tissue paper web consisting of one ply of pattern densified tissue having about 15.5 mil thickness combined with one ply of conventionally pressed tissue paper having about 7.5 mil of thickness forms a two-ply tissue paper web. The tissue paper web is passed through the gap formed between the applicator and impression cylinders wherein which the softening composition transfers from the applicator cylinder to the tissue paper web. The tissue paper web that exits the gap formed by the applicator cylinder and the impression cylinder contains about 1.5% by weight of uniformly affixed softener corresponding to the recessed areas of the gravure cylinder.

The resultant two-ply tissue web is converted into rolls of bath tissue.

Example 2

This example illustrates the use of an offset roto-gravure printer to prepare a two-ply bath tissue having uniform discrete deposits of a substantively affixed chemical softening mixture. The chemical softening mixture is applied to both exterior surfaces of the two-ply bath tissue product.

Materials used to prepare the softening composition are.

1. Tallow Diester Chloride Quaternary (ADOGEN SDMC) from WITCO Chemical Company of Greenwich, Conn.
2. Petrolatum (White Protopet 1S) from WITCO Chemical Company of Greenwich, Conn.
3. Sorbitan monostearate (Span 60 from ICI Surfactants, Inc. of Wilmington, Del.).
4. Ethoxylated sorbitan monostearate (Tween 60 from ICI Surfactants, Incorporated of Wilmington, Del.).

The softening composition is prepared by weighing appropriate amounts of each of the above identified materials, melting them and mixing them in a constant temperature vessel held at 140° F. to prepare a composition comprising: 60% tallow diester chloride quaternary ammonium compound, 22% petrolatum, 14% sorbitan monostearate, and 4% ethyloxylated sorbitan monostearate. The softening composition is then fed to a gravure pan that allows the softening composition to fill the recessed areas of the rotating gravure cylinder.

The gravure cylinder construction includes a central void area suitable for circulation of a heating fluid to maintain the surface of the roller at approximately 140° F. The surface of the gravure cylinder is clad with an aluminum oxide ceramic into which the recessed areas are engraved by a laser technique. The recessed areas are hemispherically shaped; each area having a diameter of about 400 $\mu$ and therefore a depth of about 200 $\mu$. The frequency of the recessed areas is 10 per lineal inch, such that there are 115 areas per square inch. The resultant percentage of total area covered by recessed areas is about 2.2%.

The excess softener composition is doctored from the surface of the gravure cylinder by a flexible polytetrafluoroethylene doctor blade.

The offset printer is operated such that the surface speed of its cylinders and therefore the web speed is 300 feet per minute.

The offset printer is operated such that the surface speed of its cylinders and therefore the web speed is 300 feet per minute.

The gravure cylinder is operated in contact with an applicator cylinder. The applicator cylinder has a rubber covering of 50 P&J hardness. The two cylinders are loaded into interference such that the width of area of contact of the two cylinders by virtue of the deformation of the rubber covering on the applicator cylinder is 5/32 of an inch. The softening composition thus transfers from the gravure cylinder to the applicator cylinder.

The applicator cylinder is operated in proximity with an impression cylinder. The impression cylinder is of steel construction. The cylinders are loaded to stops such that a gap of 11 mil exists between the two cylinders.

A two-ply bath tissue paper web comprised of two pattern densified plies each having a thickness of about 13 mil are combined to form two-ply tissue paper web. The tissue paper web is passed through the gap formed between the applicator and impression cylinders wherein which the softening composition transfers from the applicator cylinder to the tissue paper web. The tissue paper web that exits the gap formed by the applicator cylinder and the impression cylinder contains about 0.8% by weight of uniformly affixed softener corresponding to the recessed areas of the gravure cylinder.

The resultant two-ply bath tissue paper web is formed onto a roll and it is passed through the printing operation in the same fashion once again. On the second pass the tissue is oriented to apply a measure of softener to the surface which was not printed on the first pass. The tissue paper web that exits the gap formed by the applicator cylinder and the impression cylinder contains a total of about 1.3% by weight of uniformly affixed softener corresponding to the recessed areas of the gravure cylinder.

The resultant two-ply tissue web is passed through an opposing calender nip in order to reduce its thickness further; it is then converted into rolls of bath tissue.

Important properties of the resultant tissue are measured and the softness is compared to a product made from the same starting tissue without printing. The results of this evaluation are shown in Table 2

TABLE 2

| Tissue Properties | | |
|---|---|---|
| | Example 1 | Example 2 |
| Softener content % | 1.5% | 1.5% |
| Caliper, mil | 16 | 11.2 |
| Total Tensile Strength (g/in) | 360 | 425 |
| Softness score | +0.5 | +0.8 |

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes. and modifications can be made without departing from the spirit and scope of the invention. It is therefore intended to cover in the appended claims all such changes and modifications that are within the scope of this invention.

What is claimed is:

1. A soft tissue paper product having one or more plies, wherein at least one outer surface of the tissue paper has disposed thereon surface deposits of a substantially anhydrous substantively affixed chemical softening mixture comprising between about 40% and about 80% of a quaternary ammonium compound having at least one $C_{14}$–$C_{22}$ substituent, between about 10% and about 30% of an emollient, and between about 12% and about 20% of a polyhydroxy fatty acid ester coupling agent that associates with both the quaternary ammonium compound and the emollient to substantially reduce their migration on the tissue paper product.

2. The tissue paper of claim 1 wherein said quaternary ammonium compound has the formula:

$$(R^1)_{4-m}—N^{+}—[R^2]_m X^-$$

wherein m is 1 to 3;

each $R^1$ is a $C_1$–$C_6$ alkyl or alkenyl group, hydroxyalkyl group, hydrocarbyl or substituted hydrocarbyl group, alkoxylated group, benzyl group, or mixtures thereof;

each $R^2$ is a $C_{14}$–$C_{22}$ alkyl or alkenyl group, hydroxyalkyl group, hydrocarbyl or substituted hydrocarbyl group, alkoxylated group, benzyl group, or mixtures thereof, and $X^-$ is any softener-compatible anion.

3. The tissue paper of claim 2 wherein m is 2, $R^1$ is methyl and $R^2$ is $C_{16}$–$C_{18}$ alkyl or alkenyl.

4. The tissue paper of claim 3 wherein $X^-$ is chloride or methyl sulfate.

5. The tissue paper of claim 1 wherein said quaternary ammonium compound has the formula:

$$(R^1)_{4-m}—N^{+}—[(CH_2)_n—Y—R^3]_m X^-$$

wherein

Y is —O—(O)C—, or —C(O)—O—, or —NH—C(O)—, or —C(O)—NH—;

m is 1 to 3;

n is 0 to 4;

each $R^1$ is a $C_1$–$C_6$ alkyl or alkenyl group, hydroxyalkyl group, hydrocarbyl or substituted hydrocarbyl group, alkoxylated group, benzyl group, or mixtures thereof;

each $R^3$ is a $C_{13}$–$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

6. The tissue paper of claim 5 wherein m is 2, n is 2, $R^1$ is methyl, $R^3$ is $C_{15}$–$C_{17}$ alkyl or alkenyl, and Y is —O—(O)C—, or —C(O)—O—.

7. The tissue paper of claim 6 wherein $X^-$ is chloride or methyl sulfate.

8. The tissue paper of claim 1 wherein said emollient is selected from a group consisting of mineral oil, petrolatum and polysiloxane compounds.

9. The tissue paper of claim 8 wherein said emollient is petrolatum.

10. The tissue paper of claim 1 wherein said coupling agent has an HLB value of between about 2 and about 8.

11. The tissue paper of claim 1 wherein said coupling agent is a sorbitan fatty acid ester.

12. The tissue paper of claim 11 wherein said sorbitan fatty acid ester is a $C_{16}$–$C_{22}$ saturated fatty acid ester.

13. The tissue paper of claim 12 wherein said sorbitan fatty acid ester is a sorbitan stearate ester.

14. The tissue paper of claim 9 wherein said coupling agent is a sorbitan fatty acid ester.

15. The tissue paper of claim 14 wherein said sorbitan fatty acid ester is a $C_{16}$–C22 saturated fatty acid ester.

16. The tissue paper of claim 15 wherein said sorbitan fatty acid ester is a sorbitan stearate ester.

17. The tissue paper of claim 16 wherein said chemical softening mixture further comprises an ethyloxylated sorbitan monostearate having a ratio of sorbitan monostearate to ethoxylated sorbitan monostearate between about 2:1 and about 4:1.

18. The tissue paper of claim 16 wherein said ethyloxylated sorbitan monostearate contains from about 10 to about 50 moles of ethylene oxide per mole of ethyloxylated sorbitan monostearate.

19. The tissue paper of claim 17 wherein said quaternary ammonium compound has the formula:

$$(R^1)_{4-m}—N^+—[(CH_2)_n—Y—R^3]_mX^-$$

wherein

Y is —O—(O)C—, or —C(O)—O—, or —NH—C(O)—, or —C(O)—NH—;

m is 1 to 3;

n is 0 to 4;

each $R^1$ is a $C_1$–$C_6$ alkyl or alkenyl group, hydroxyalkyl group, hydrocarbyl or substituted hydrocarbyl group, alkoxylated group, benzyl group, or mixtures thereof;

each $R^3$ is a $C_{13}$–$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

20. The tissue paper of claim 19 wherein m is 2, n is 2, $R^1$ is methyl, $R^3$ is $C_{15}$–$C_{17}$ alkyl or alkenyl, and Y is —O—(O)C—, or —C(O)—O—.

21. The tissue paper of claim 20 wherein $X^-$ is chloride or methyl sulfate.

22. The tissue paper of claim 1 wherein said paper is pattern densified.

23. The tissue paper of claim 7 wherein said paper is pattern densified.

24. The tissue paper of claim 9 wherein said paper is pattern densified.

25. The tissue paper of claim 17 wherein said paper is pattern densified.

26. The tissue paper of claim 1 wherein the paper is uncreped, through-air dried paper.

27. The tissue paper of claim 1 wherein said chemical softening mixture comprises from about 0.1% to about 10% by weight of the paper.

28. The tissue paper of claim 7 wherein said chemical softening agent comprises from about 0.1% to about 10% by weight of the paper.

29. The tissue paper of claim 17 wherein said chemical softening agent comprises from about 0.1% to about 10% by weight of the paper.

30. The tissue paper of claim 1 wherein said surface deposits are uniform, discrete and spaced apart at a frequency between about 1 area per lineal inch and about 100 areas per lineal inch.

31. The tissue paper of claim 1 wherein said surface deposits are uniform, discrete and spaced apart at a frequency between about 1 area per lineal inch and about 100 areas per lineal inch.

32. The tissue paper of claim 7 wherein said surface deposits are uniform, discrete and spaced apart at a frequency between about 1 area per lineal inch and about 100 areas per lineal inch.

33. The tissue paper of claim 29 wherein said surface deposits are uniform, discrete and spaced apart at a frequency between about 1 area per lineal inch and about 100 areas per lineal inch.

34. The tissue paper of claim 33 wherein said surface deposits are uniform, discrete and spaced apart at a frequency between about 5 areas per lineal inch and about 25 areas per lineal inch.

* * * * *

UNITED STATES PATENT AND TRADEMARK OFFICE

CERTIFICATE OF CORRECTION

PATENT NO. : 6,179,961 B1 
DATED : January 30, 2001
INVENTOR(S) : Jonathan A. Ficke et al.

It is certified that error appears in the above-identified patent and that said Letters Patent is hereby corrected as shown below:

Column 1,
Line 47, "perineal" should read -- perianal --.

Column 4,
Line 24, "DEDHIDMAC" should read -- DEDHTDMAC --.

Signed and Sealed this

Eighteenth Day of June, 2002

*Attest:*

*Attesting Officer*

JAMES E. ROGAN
*Director of the United States Patent and Trademark Office*